US009605850B2

(12) United States Patent
Stecker

(10) Patent No.: US 9,605,850 B2
(45) Date of Patent: Mar. 28, 2017

(54) ADJUSTABLE FIREPLACE SCREEN SUPPORT ASSEMBLY AND METHOD FOR INSTALLING A FIREPLACE SCREEN IN A FIREPLACE

(71) Applicant: S&S Products, LLC, Sterling Heights, MI (US)

(72) Inventor: Steve Stecker, Sterling Heights, MI (US)

(73) Assignee: S&S Products, LLC, Sterling Heights, MI (US)

( * ) Notice: Subject to any disclaimer, the term of this patent is extended or adjusted under 35 U.S.C. 154(b) by 491 days.

(21) Appl. No.: 14/291,034

(22) Filed: May 30, 2014

(65) Prior Publication Data

US 2015/0345798 A1 Dec. 3, 2015

(51) Int. Cl.
*F24B 1/192* (2006.01)
*A47G 5/04* (2006.01)

(52) U.S. Cl.
CPC ..... *F24B 1/192* (2013.01); *A47G 5/04* (2013.01); *Y10T 29/49828* (2015.01)

(58) Field of Classification Search
CPC ..... F24B 1/192; A47G 5/04; A47H 1/022; A47H 1/08; A47H 1/122
See application file for complete search history.

(56) References Cited

U.S. PATENT DOCUMENTS 1,327,460 A * 1/1920 Collins ..... A47H 1/022 248/252
2,562,371 A * 7/1951 Shannon ..... A47G 5/04 126/551
2,601,489 A * 6/1952 Babros ..... A47G 5/04 126/551

* cited by examiner

*Primary Examiner* — Jason Lau
(74) *Attorney, Agent, or Firm* — Buckert Patent & Trademark Law firm, PC; John F. Buckert

(57) ABSTRACT

An adjustable fireplace screen support assembly is provided. The adjustable fireplace screen support assembly includes an elongated member having a first end and a second end. The support assembly further includes a first tip member coupled to the first end of the elongated member. The support assembly further includes a tubular member having a first end and a second end. The second end of the elongated member is slidably disposed through the first end of the tubular member and into the interior region. The support assembly further includes a second tip member coupled to the tubular member. The support assembly further includes a biasing assembly at least partially disposed in the interior region of the tubular member adapted to bias the elongated member in a first direction, and the tubular member in a second direction.

8 Claims, 7 Drawing Sheets

ADJUSTABLE FIREPLACE SCREEN SUPPORT ASSEMBLY AND METHOD FOR INSTALLING A FIREPLACE SCREEN IN A FIREPLACE

BACKGROUND

The inventor herein has recognized a need for an adjustable fireplace screen support assembly and an improved method for installing a fireplace screen in a fireplace.

SUMMARY

An adjustable fireplace screen support assembly in accordance with an exemplary embodiment is provided. The adjustable fireplace screen support assembly includes an elongated member having a first end and a second end. The elongated member extends along a longitudinal axis. The adjustable fireplace screen support assembly further includes a first tip member having a first tip portion and a first ring-shaped portion. The first ring-shaped portion is coupled to the first tip portion. The first tip portion member is coupled to the first end of the elongated member. The adjustable fireplace screen support assembly further includes a tubular member having a first end and a second end. The tubular member extends along the longitudinal axis and defines an interior region. The interior region has a diameter that is greater than an outer diameter of the elongated member. The second end of the elongated member is slidably disposed through the first end of the tubular member and into the interior region. The adjustable fireplace screen support assembly further includes a second tip member having a second tip portion and a second ring-shaped portion. The second ring-shaped portion is coupled to and disposed around a periphery of the second tip portion. A portion of the second tip portion is disposed in the interior region proximate to the second end of the tubular member such that the second ring-shaped portion abuts against the second end of the tubular member, the second ring-shaped portion being coupled to the tubular member. The adjustable fireplace screen support assembly further includes a biasing assembly at least partially disposed in the interior region of the tubular member. The biasing assembly is adapted to bias the elongated member in a first direction along the longitudinal axis, and to bias the tubular member in a second direction along the longitudinal axis which is opposite to the first direction.

A method for installing a fireplace screen in a fireplace in accordance with another exemplary embodiment is provided. The method includes providing an adjustable fireplace screen support assembly having an elongated member, a first tip member, a tubular member, a second tip member, and a biasing assembly. The elongated member is at least partially slidably disposed within the tubular member. The biasing assembly is disposed within the tubular member. The biasing assembly is adapted to bias the elongated member in a first direction, and the tubular member in a second direction opposite to the first direction. The first tip member is coupled to an end of the elongated member. The second tip member is coupled to an end of the tubular member. The method further includes coupling at least first and second split-ring members on the fireplace screen. The method further includes disposing the adjustable fireplace screen support assembly through the first and second split-ring members such that the first split-ring member is slidably disposed on the elongated member, and the second split-ring member is slidably disposed on the tubular member. The method further includes disposing the first tip member against a first wall of the fireplace. The method further includes applying a compressive force against the biasing assembly by moving the tubular member toward the first tip member. The method further includes disposing the second tip member against a second wall of the fireplace. The method further includes rotating the adjustable fireplace screen support assembly such that the first and second tip members form first and second apertures, respectively, into the first and second walls, respectively, of the fireplace.

DETAILED DESCRIPTION

Figure 1:
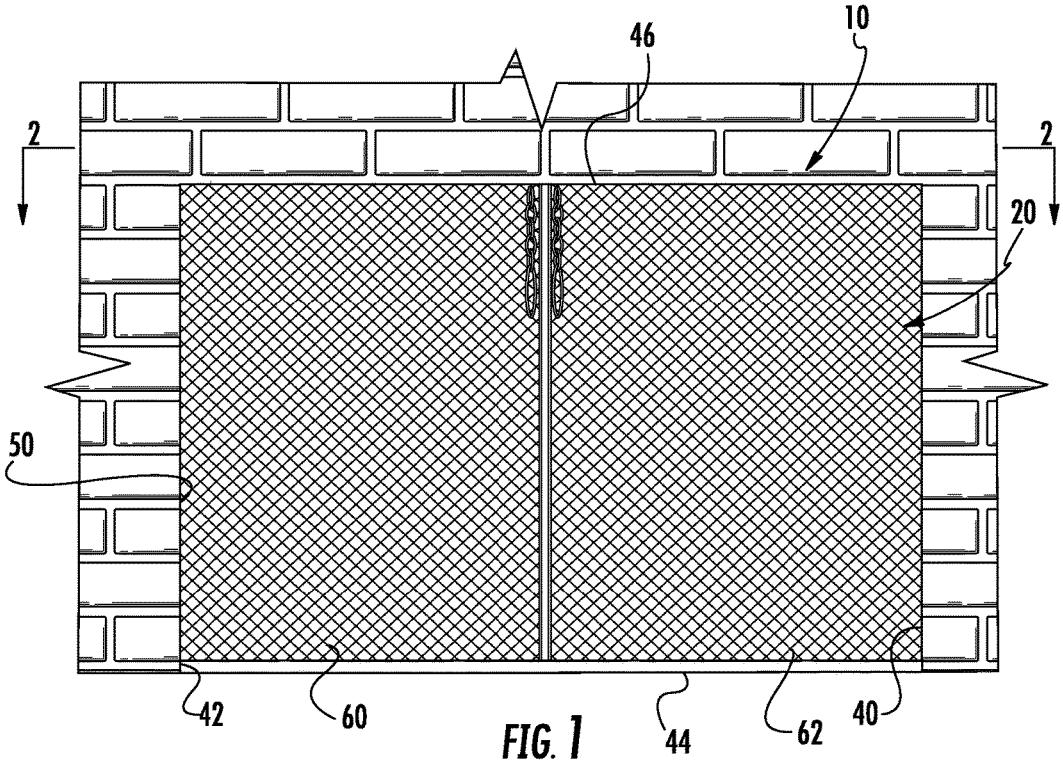
FIG. 1 is a schematic of a fireplace having a fireplace screen.
Figure 4:
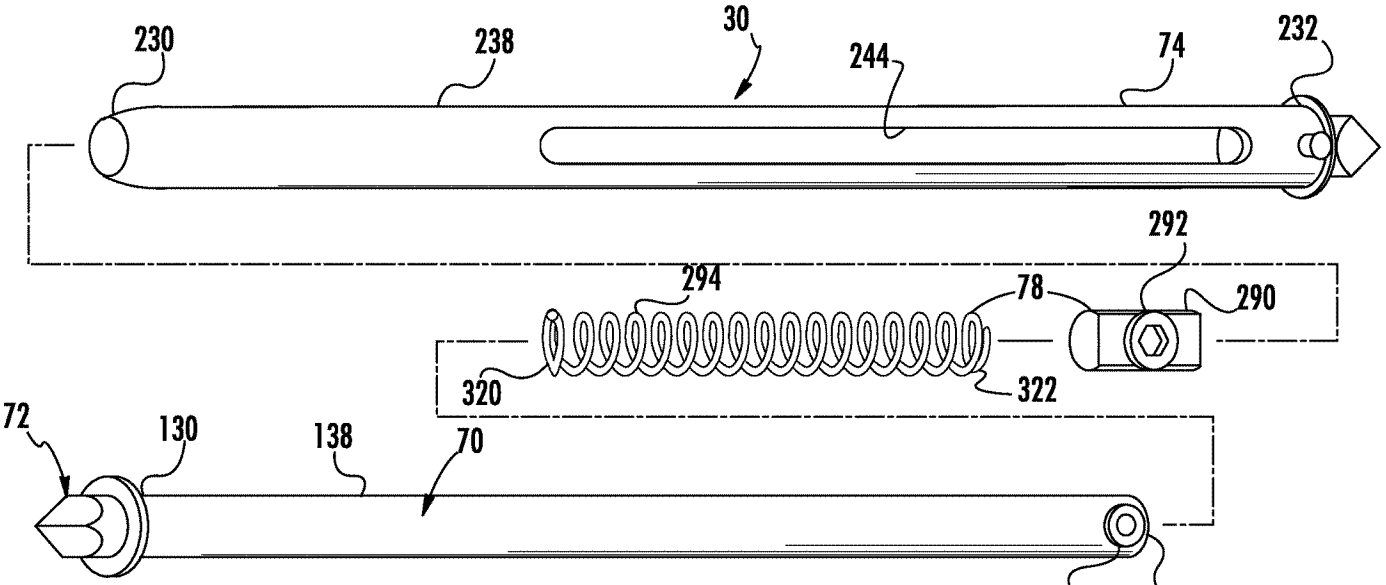
FIG. 4 is an exploded schematic of the adjustable fireplace screen support assembly of FIG. 3.
Figure 10:
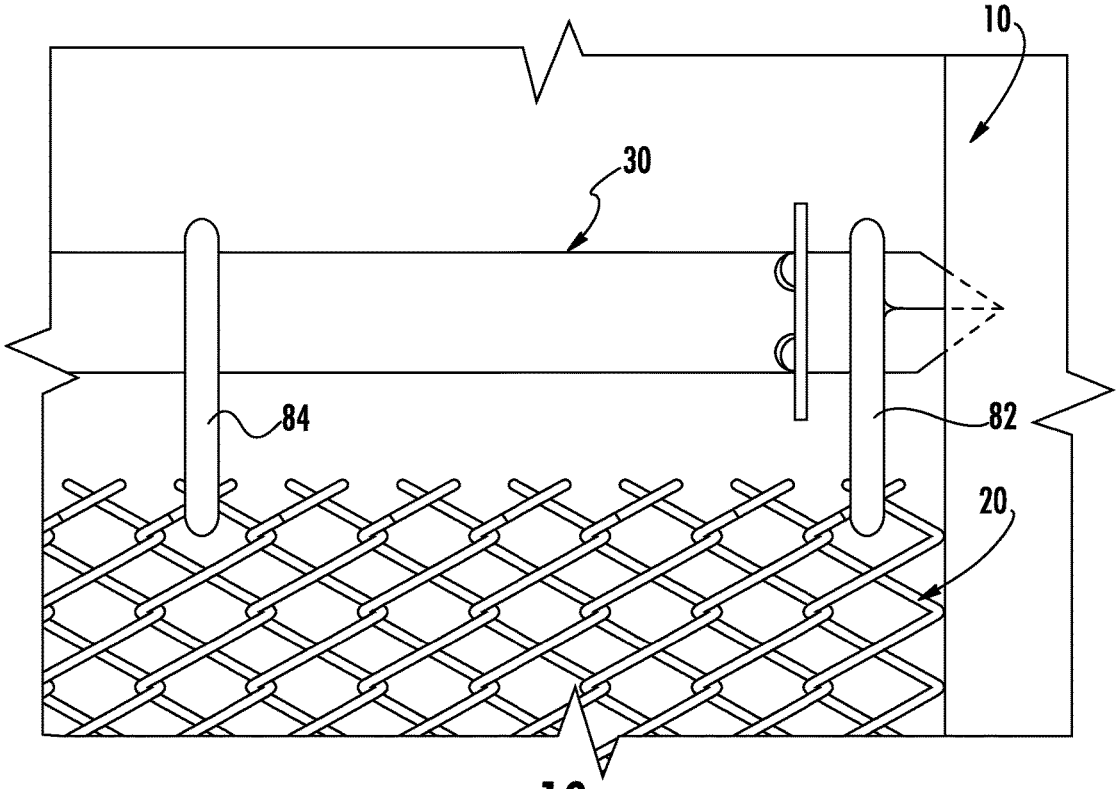
FIG. 10 is an enlarged schematic of a portion of the adjustable fireplace screen support assembly of FIG. 3 coupled to the fireplace screen of FIG. 1.

Referring to FIGS. 1, 4 and 10, a fireplace 10 having a fireplace screen 20 is illustrated. The fireplace screen 20 is coupled to the fireplace 10 utilizing an adjustable fireplace screen support assembly 30 in accordance with an exemplary embodiment. An advantage of the adjustable fireplace screen support assembly 30 is that the assembly 30 utilizes an internal biasing assembly 78 to adjust a longitudinal length of the assembly 30 such that the assembly 30 that can be mounted to different sized fireplaces.

The fireplace 10 includes first, second, third, and fourth walls 40, 42, 44, 46 that define an opening 50. In an exemplary embodiment, the first, second, third, and fourth walls 40, 42, 44, 46 are constructed of concrete or fire bricks.

The fireplace screen 20 is adapted and sized to substantially cover the opening 50 of the fireplace 10. The fireplace screen 20 includes a screen portion 60 and a screen portion 62 each constructed of a wire mesh.

Figure 2:
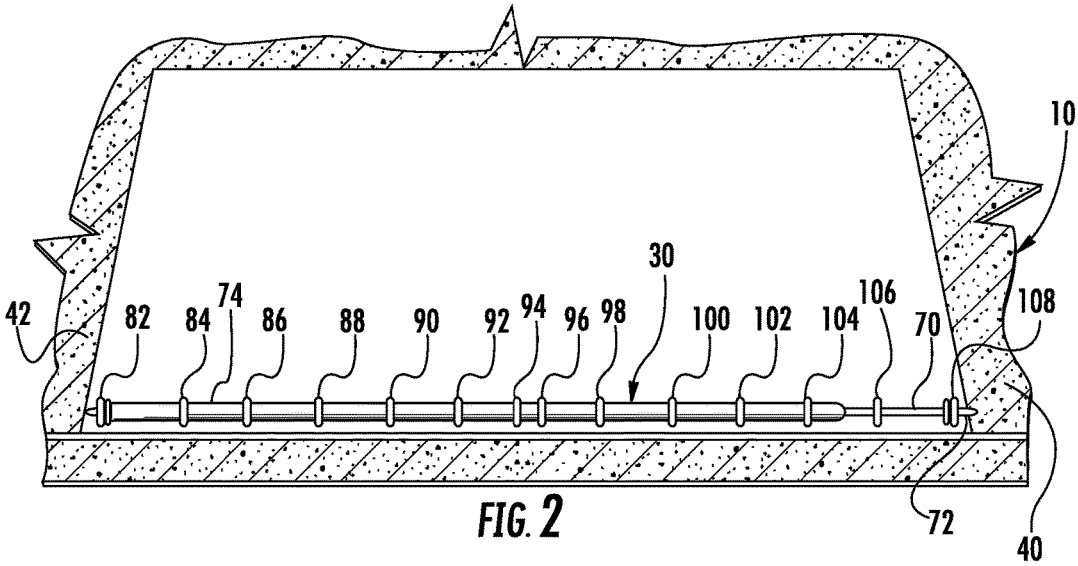
FIG. 2 is a schematic of a portion of the fireplace of FIG. 1 having an adjustable fireplace screen support assembly disposed therein in accordance with an exemplary embodiment.
Figure 3:
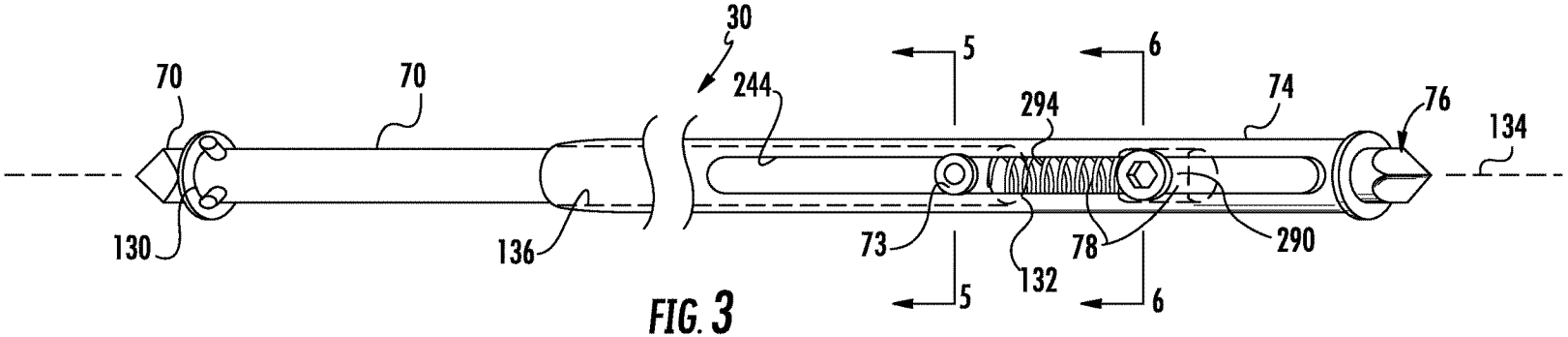
FIG. 3 is a schematic of the adjustable fireplace screen support assembly of FIG. 2.

Referring to FIGS. 2-4, the adjustable fireplace screen support assembly 30 is provided to hold the fireplace screen 20 thereon such that the fireplace screen 20 is positioned to cover the opening 50. The adjustable fireplace screen support assembly 30 includes an elongated member 70, a first tip member 72, a rivet 73, a tubular member 74, a second tip member 76, a biasing assembly 78, split-ring members 82, 84, 86, 88, 90, 92, 94, 96, 98, 100, 102, 104, 106, 108.

Figure 5:
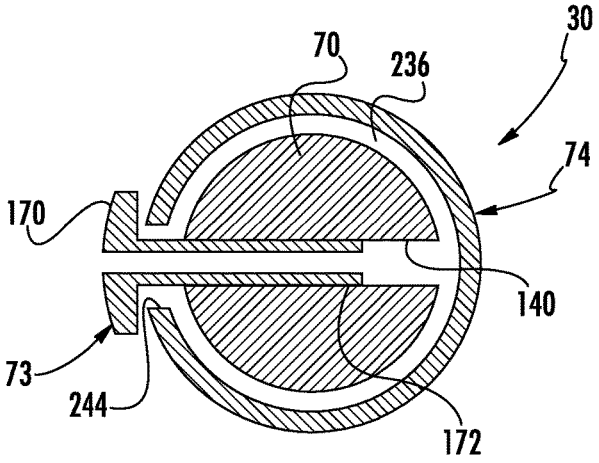
FIG. 5 is a cross-sectional schematic of the adjustable fireplace screen support assembly of FIG. 3 taken along lines 5-5.
Figure 11:
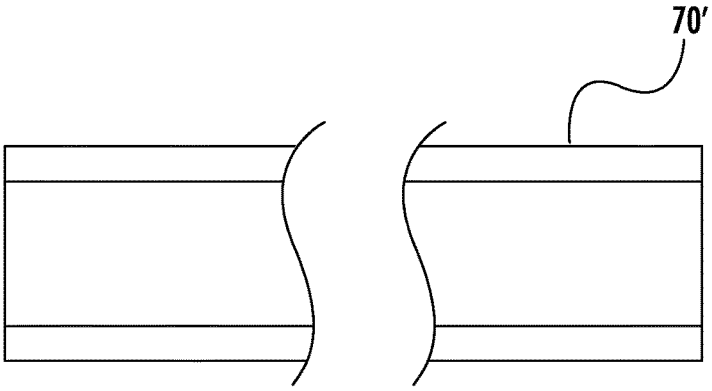
FIG. 11 is a schematic of an alternative embodiment of an elongated member that can be utilized in the adjustable fireplace screen support assembly of FIG. 3.
Figure 12:
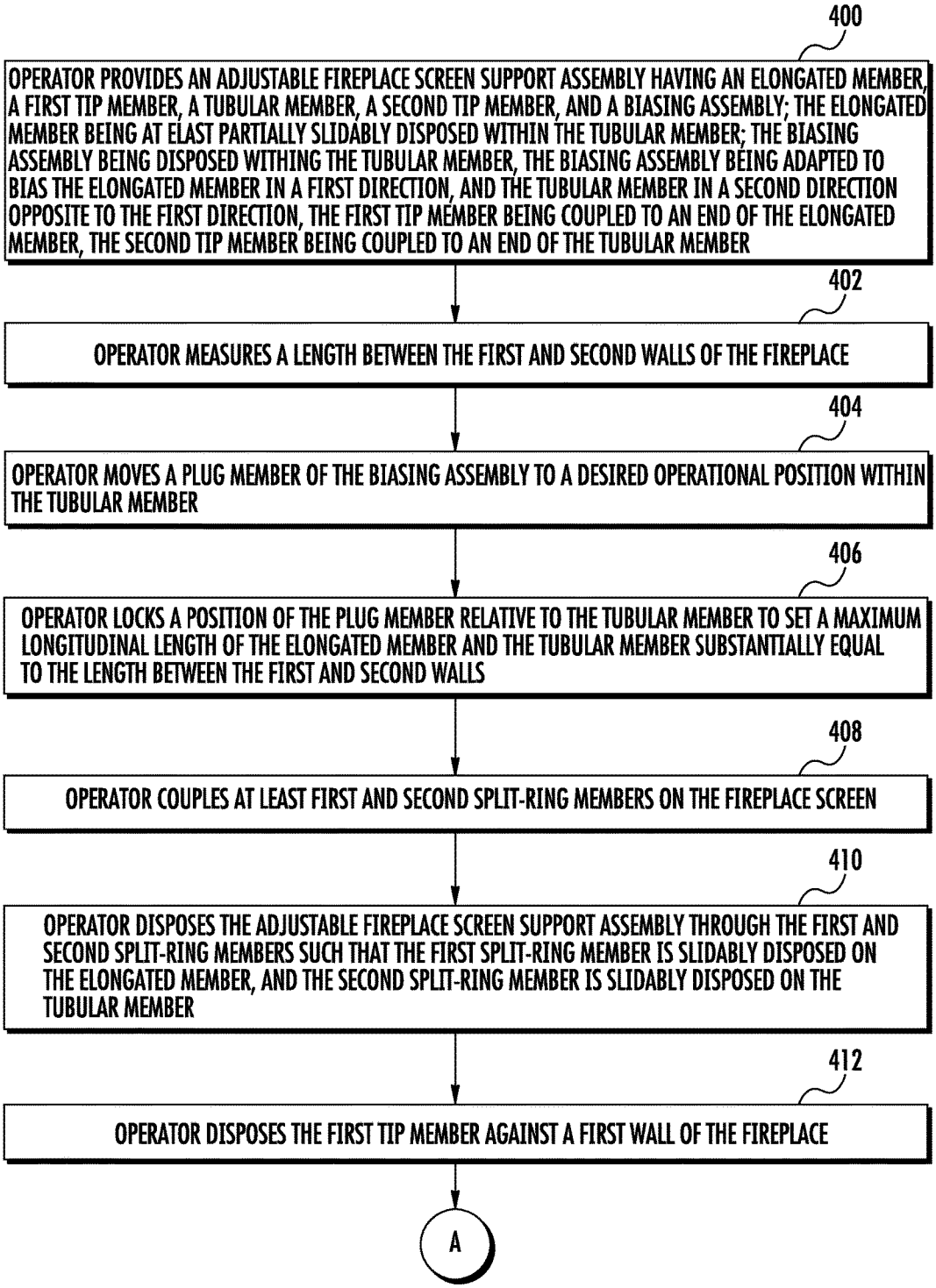
FIGS. 12-13 are flowcharts of a method for installing a fireplace screen in a fireplace in accordance with another exemplary embodiment.
Figure 13:
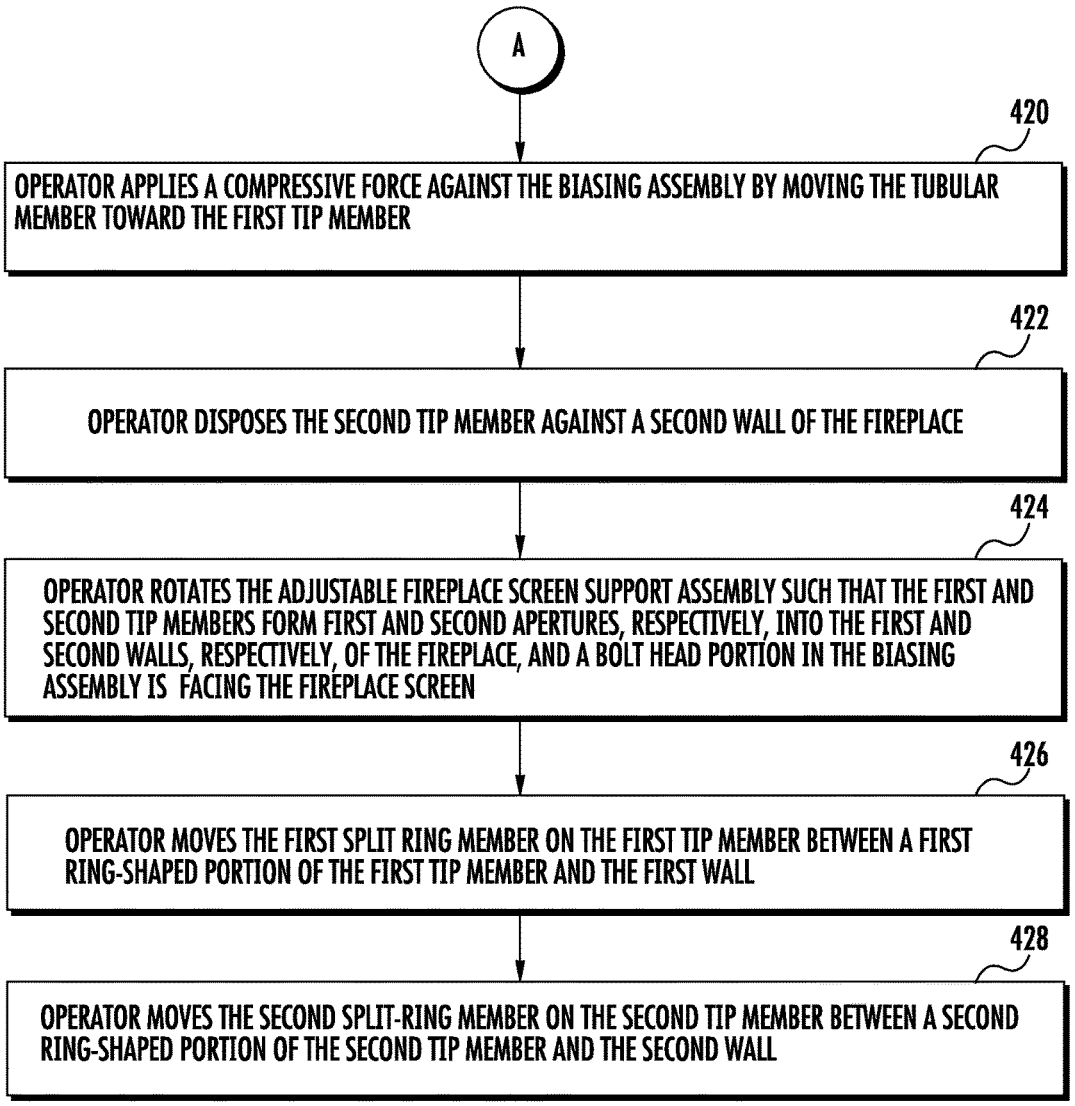

Referring to FIGS. 3-5, the elongated member 70 has a first end 130 and a second end 132 and extends along a longitudinal axis 134. The elongated member 70 further includes an outer surface 138 and an aperture 140 extending through a portion of the elongated member 74 for receiving a shaft portion 172 of the rivet 73 therein. In an exemplary embodiment, the elongated member 70 is a solid rod. However, referring to FIG. 11, in an alternative embodiment, the elongated member 70 could be replaced with a tubular member 70'. In an exemplary embodiment, the elongated member 70 is constructed of steel. However, in an alternative embodiment, the elongated member 70 could be constructed of other materials such as stainless steel for example. The elongated member 70 is adapted to be at least partially received within an interior region 236 of the tubular member 74.

Referring to FIGS. 2, 3, 4 and 7, the first tip member 72 is provided to couple the adjustable fireplace screen support assembly 32 to the wall 42. The first tip member 72 includes a first tip portion 160 and a first ring-shaped portion 162. The first ring-shaped portion 162 is coupled to the first tip portion 160. The first tip portion 160 defines a substantially pointed tip 104. As shown, the first tip member 72 is coupled to the first end 130 of the elongated member 70. In an exemplary embodiment, the first tip member 72 is constructed of steel. Of course, in an alternative embodiment, the first tip member 72 could be constructed of other materials such as stainless steel for example.

Referring to FIGS. 3-5, the rivet 73 is provided to assist in guiding the elongated member 70 within the tubular member 74. The rivet 73 includes a head portion 170 and a shaft portion 172. The shaft portion 172 extends through the elongated aperture 244 of the tubular member 74 and is coupled to the elongated member 70. The head portion 170 is slidably disposed against an outer surface 238 of the tubular member 74 proximate to the elongated aperture 244 when the elongated member 70 is at least partially disposed within the tubular member 74.

The tubular member 74 includes a first end 230, a second end 232, and an outer surface 238. The tubular member 74 extends along the longitudinal axis 134 and defines the interior region 236. The tubular member 74 further includes the elongated aperture 244 extending through an outer wall of the tubular member 74. In an exemplary embodiment, the tubular member 74 is constructed of steel. Of course, in an alternative embodiment, the tubular member 74 could be constructed of other materials such as stainless steel for example. The interior region 236 has a diameter that is greater than an outer diameter of the elongated member 70. The second end 232 of the elongated member 70 is slidably disposed through the first end 230 of the tubular member 74 and into the interior region 236.

Referring to FIGS. 2, 3, 4 and 9, the second tip member 76 is provided to couple the adjustable fireplace screen support assembly 32 to the wall 40. The second tip member 76 includes a second tip portion 260 and a second ring-shaped portion 262. The second ring-shaped portion 262 is coupled to and disposed around a periphery of the second tip portion 260. The second tip portion 260 defines a substantially pointed tip 264. A portion of the second tip portion 260 is disposed in the interior region 236 proximate to the second end 232 of the tubular member 74 such that the second ring-shaped portion 262 abuts against the second end 232 of the tubular member 74. The second ring-shaped portion 262 is further coupled to the tubular member 74. In an exemplary embodiment, the second tip member 76 is constructed of steel. Of course, in an alternative embodiment, the second tip member 76 could be constructed of other materials such as stainless steel for example.

Figure 6:
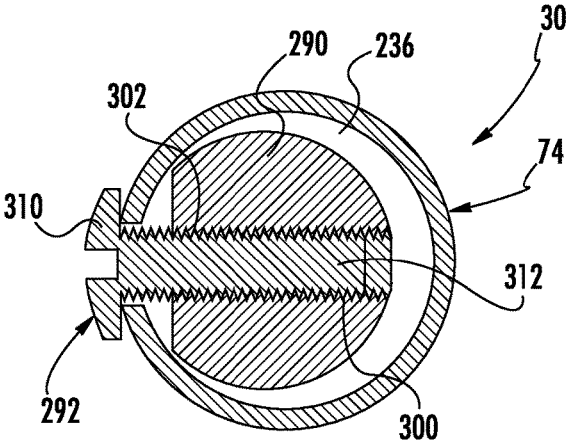
FIG. 6 is a cross-sectional schematic of the adjustable fireplace screen support assembly of FIG. 3 taken along lines 6-6.
Figure 7:
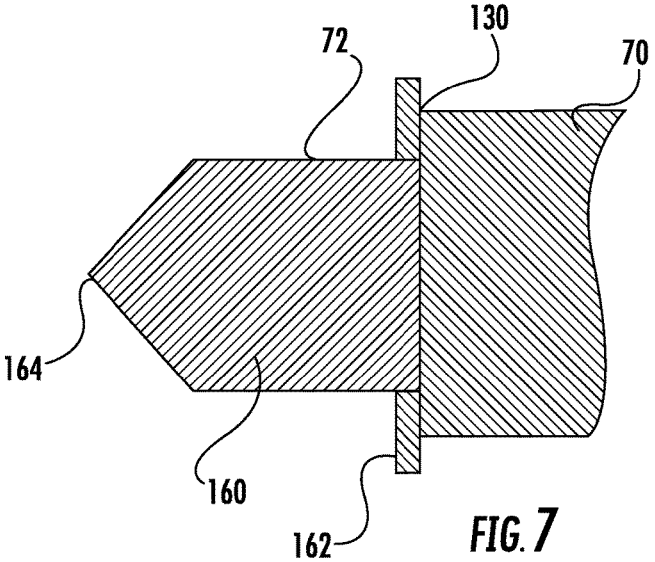
FIG. 7 is a cross-sectional schematic of an end portion of the adjustable fireplace screen support assembly of FIG. 3.
Figure 8:
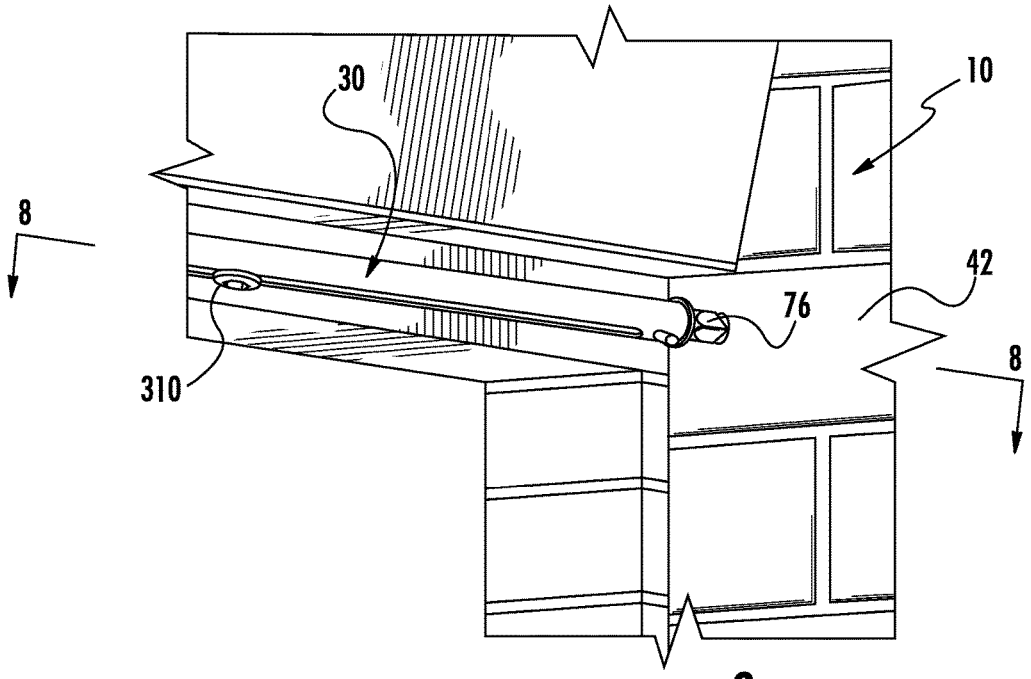
FIG. 8 is a schematic of a portion of the fireplace of FIG. 1 and a portion of the adjustable fireplace screen support assembly of FIG. 3 installed in the fireplace.
Figure 9:
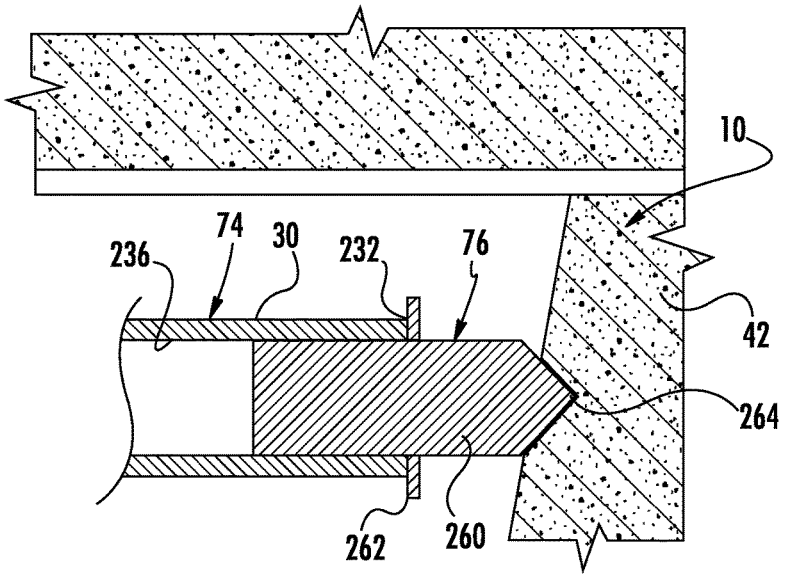
FIG. 9 is a cross-sectional schematic of another end portion of the adjustable fireplace screen support assembly of FIG. 3.

Referring to FIGS. 3, 4 and 6, the biasing assembly 78 is at least partially disposed in the interior region 236 of the tubular member 74. The biasing assembly 78 is adapted to bias the elongated member 70 in a first direction (e.g., leftwardly in FIG. 3) along the longitudinal axis 134, and to bias the tubular member 74 in a second direction (e.g., rightwardly in FIG. 3) along the longitudinal axis 134 which is opposite to the first direction. The biasing assembly 78 includes a plug member 290, a bolt 292, and a spring 294.

The bolt 292 has a threaded portion 312 and a head portion 310 coupled to an end of the threaded portion 312. The threaded portion 312 is threadably received into the aperture 300 of the plug member 290. In particular, the aperture 300 defines internal threads 302 within the plug member 290 that are configured to threadably receive the threaded portion 312. The head portion 310 is adapted to abut against the outer surface 238 of the tubular member 74 at a desired position when the bolt 292 is tightened such that a maximum longitudinal length of the elongated member 70 and the tubular member 74 is set to a desired longitudinal length. In an exemplary embodiment, the bolt 292 is constructed of steel. Of course, in an alternative embodiment, the bolt 292 could be constructed of other materials such as stainless steel for example.

The plug member 290 is disposed in the interior region 236 of the tubular member 74 such that a portion of the threaded portion 312 of the bolt 292 extends through the elongated aperture 244 of the tubular member 74 and the head portion 310 of the bolt 292 rests on the outer surface 238 of the tubular member 74. In an exemplary embodiment, the plug member 290 is constructed of steel. Of course, in an alternative embodiment, the plug member 290 could be constructed of other materials such as stainless steel for example.

Referring to FIGS. 3 and 4, the spring 294 is disposed in the interior region 236 of the tubular member 74. The spring 294 is disposed between and abuts against both the plug member 290 and the first end 130 of the elongated member 70. The spring 294 is adapted to bias the elongated member 70 in the first direction (e.g., leftwardly in FIG. 3) along the longitudinal axis 134, and to bias the tubular member 74 in the second direction (e.g., rightwardly in FIG. 3) along the longitudinal axis 134 which is opposite to the first direction. In an exemplary embodiment, the spring 294 is constructed of steel.

Referring to FIGS. 2-4, the split-ring members 82-108 are provided to couple the fireplace screen 20 to the adjustable fireplace screen support assembly 30. In an exemplary embodiment, the split-ring members 106, 108 are disposed on the outer surface 138 of the elongated member 70, and the split-ring members 82-104 are disposed on the outer surface 238 of the tubular member 74. Each of the split-ring members 82-108 have a diameter greater than a diameter of the elongated member 70 and a diameter of the tubular member 74. Further, each of the split-ring members 82-108 have a diameter greater than a diameter of the first tip member 72 and a diameter of the second tip member 76. In an exemplary embodiment, the split-ring members 82-108 are constructed of steel. Of course, in an alternative embodiment, the split-ring members 82-108 could be constructed of other materials such as stainless steel for example.

Referring to FIGS. 2, 3 and 12-13, a flowchart of a method for installing the fireplace screen 20 in the fireplace 10 in accordance with another exemplary embodiment will be described.

At step 400, an operator provides the adjustable fireplace screen support assembly 30 having the elongated member 70, the first tip member 72, the tubular member 74, the second tip member 76, and the biasing assembly 78. The elongated member 70 is at least partially slidably disposed within the tubular member 74. The biasing assembly 78 is disposed within the tubular member 74. The biasing assembly 78 is adapted to bias the elongated member 70 in a first direction, and the tubular member 74 in a second direction opposite to the first direction. The first tip member 72 is coupled to an end of the elongated member 70. The second tip member 76 is coupled to an end of the tubular member 74. After step 400, the method advances to step 402.

At step 402, the operator measures a length between the first and second walls 40, 42 of the fireplace 10. After step 402, the method advances to step 404.

At step 404, the operator moves the plug member 290 of the biasing assembly 78 to a desired operational position within the tubular member 74. After step 404, the method advances to step 406.

At step 406, the operator locks a position of the plug member 290 relative to the tubular member 74 to set a maximum longitudinal length of the elongated member 70 and the tubular member 74 substantially equal to the length between the first and second walls 40, 42. After step 406, the method advances to step 408.

At step 408, the operator couples at least first and second split-ring members 108, 82 on the fireplace screen 20. After step 408, the method advances to step 410.

At step 410, the operator disposes the adjustable fireplace screen support assembly 30 through the first and second split-ring members 82, 108 such that the first split-ring member 108 is slidably disposed on the elongated member 70, and the second split-ring member 82 is slidably disposed on the tubular member 74. After step 410, the method advances to step 412.

At step 412, the operator disposes the first tip member 72 against the first wall 40 of the fireplace 10. After step 412, the method advances to step 420.

At step 420, the operator applies a compressive force against the biasing assembly 78 by moving the tubular member 74 toward the first tip member 72. After step 420, the method advances to step 422.

At step 422, the operator disposes the second tip member 76 against the second wall 42 of the fireplace 10. After step 422, the method advances to step 424.

At step 424, the operator rotates the adjustable fireplace screen support assembly 30 such that the first and second tip members 72, 76 form first and second apertures, respectively, into the first and second walls 40, 42, respectively, of the fireplace 10, and a bolt head portion 310 in the biasing assembly 78 is facing the fireplace screen 20. After step 424, the method advances to step 426.

At step 426, the operator moves the first split-ring member 108 on the first tip member 72 between the first ring-shaped portion 162 of the first tip member 72 and the first wall 40. After step 426, the method advances to step 428.

At step 428, the operator moves the second split-ring member 82 on the second tip member 76 between the second ring-shaped portion 262 of the second tip member 76 and the second wall 42.

The adjustable fireplace screen support assembly 30 provides a substantial advantage over other assemblies. In particular, the assembly 30 utilizes an internal biasing assembly 78 to adjust a longitudinal length of the assembly 30 such that the assembly 30 that can be mounted to different sized fireplaces.

While the claimed invention has been described in detail in connection with only a limited number of embodiments, it should be readily understood that the invention is not limited to such disclosed embodiments. Rather, the claimed invention can be modified to incorporate any number of variations, alterations, substitutions or equivalent arrangements not heretofore described, but which are commensurate with the spirit and scope of the invention. Additionally, while various embodiments of the claimed invention have been described, it is to be understood that aspects of the invention may include only some of the described embodiments. Accordingly, the claimed invention is not to be seen as limited by the foregoing description.

What is claimed is:

1. An adjustable fireplace screen support assembly, comprising:

an elongated member having a first end and a second end, the elongated member extending along a longitudinal axis;

a first tip member having a first tip portion and a first ring-shaped portion, the first ring-shaped portion being coupled to the first tip portion, the first tip member being coupled to the first end of the elongated member;

a tubular member having a first end and a second end, the tubular member extending along the longitudinal axis and defining an interior region, the interior region having a diameter that is greater than an outer diameter of the elongated member, the second end of the elongated member being slidably disposed through the first end of the tubular member and into the interior region;

a second tip member having a second tip portion and a second ring-shaped portion, the second ring-shaped portion being coupled to and disposed around a periphery of the second tip portion, a portion of the second tip portion being disposed in the interior region proximate to the second end of the tubular member such that the second ring-shaped portion abuts against the second end of the tubular member, the second ring-shaped portion being coupled to the tubular member;

a biasing assembly at least partially disposed in the interior region of the tubular member, the biasing assembly adapted to bias the elongated member in a first direction along the longitudinal axis, and to bias the tubular member in a second direction along the longitudinal axis which is opposite to the first direction;

the tubular member further includes an out wall having an elongated aperture extending therethrough;

the biasing assembly having a plug member, a bolt, and a spring; the bolt having a threaded portion and a head portion coupled to an end of the threaded portion, the threaded portion being threadably disposed into the plug member, the plug member being disposed in the interior region of the tubular member such that a portion of the threaded portion extends through the elongated aperture of the tubular member and the head portion rests on the outer surface of the tubular member;

the spring being disposed in the interior region of the tubular member, the spring being disposed between and abutting against both the plug member and the first end of the elongated member, the spring adapted to bias the elongated member in the first direction along the longitudinal axis, and to bias the tubular member in the second direction along the longitudinal axis which is opposite to the first direction; and a rivet having a head portion and a shaft portion, the shaft portion extending through the elongated aperture and being coupled to the elongated member, the head portion being slidably disposed against the outer surface of the tubular member proximate to the elongated aperture when the elongated member is at least partially disposed within the tubular member.

2. The adjustable fireplace screen support assembly of claim 1, wherein the head portion of the bolt being adapted to abut against the outer surface of the tubular member at a desired position such that a maximum longitudinal length of the elongated member and the tubular member is set to a desired longitudinal length.

3. The adjustable fireplace screen support assembly of claim 1, wherein the first tip member is constructed of steel, and the first tip portion defines a substantially pointed tip.

4. The adjustable fireplace screen support assembly of claim 3, wherein the second tip member is constructed of steel, and the second tip portion defines a substantially pointed tip.

5. The adjustable fireplace screen support assembly of claim 1, further comprising:

a first split-ring member being slidably disposed on an outer surface of elongated member, the first split-ring member having a diameter greater than a diameter of the first ring-shaped portion of the first tip member; and a second split-ring member being slidably disposed on the exterior surface of tubular member, the second split-ring member having a diameter greater than a diameter of the second ring-shaped portion of the second tip member.

6. The adjustable fireplace screen support assembly of claim 1, wherein the elongated member and the tubular member are each constructed of steel.

7. A method for installing a fireplace screen in a fireplace, comprising:

providing an adjustable fireplace screen support assembly having an elongated member, a first tip member, a tubular member, a second tip member, a biasing assembly, and a rivet; the elongated member being at least partially slidably disposed within the tubular member; the biasing assembly being disposed within the tubular member, the biasing assembly being adapted to bias the elongated member in a first direction, and the tubular member in a second direction opposite to the first direction, the first tip member being coupled to an end of the elongated member, the second tip member being coupled to an end of the tubular member; the tubular member further includes an outer wall having an elongated aperture extending therethrough; the biasing assembly having a plug member, a bolt, and a spring; the bolt having a threaded portion and a head portion coupled to an end of the threaded portion, the threaded portion being threadably disposed into the plug member, the plug member being disposed in the interior region of the tubular member such that portion of the threaded portion extends through the elongated aperture of the tubular member and the head portion rests on an outer surface of the tubular member; the spring being disposed in the interior region of the tubular member, the spring being disposed between and abutting against both the plug member and the first end of the elongated member, the spring adapted to bias the elongated member in the first direction along the longitudinal axis, and to bias the tubular member in the second direction along the longitudinal axis which is opposite to the first direction; the rivet having a head portion and a shaft portion, the shaft portion extending through the elongated aperture and being coupled to the elongated member proximate to the elongated aperture when the elongated member is at least partially disposed within the tubular member;

coupling at least first and second split-ring members on the fireplace screen;

disposing the adjustable fireplace screen support assembly through the first and second split-ring members such that the first split-ring member is slidably disposed on the elongated member, and the second split-ring member is slidably disposed on the tubular member;

disposing the first tip member against a first wall of the fireplace;

applying a compressive force against the biasing assembly by moving the tubular member toward the first tip member;

disposing the second tip member against a second wall of the fireplace; and rotating the adjustable fireplace screen support assembly such that the first and second tip members form first and second apertures, respectively, into the first and second walls, respectively, of the fireplace.

8. The method of claim 7, further comprising:

measuring a length between the first and second walls of the fireplace;

moving a plug member of the biasing assembly to a desired operational position within the tubular member; and locking a position of the plug member relative to the tubular member to set a maximum longitudinal length of the elongated member and the tubular member substantially equal to the length between the first and second walls.

* * * * *